US006604477B1

(12) United States Patent
Hozan

(10) Patent No.: US 6,604,477 B1
(45) Date of Patent: Aug. 12, 2003

(54) METHOD OF MANUFACTURE FOR A BOOT FOR THE PHYSICALLY IMPAIRED

(76) Inventor: Oltea Hozan, 629 SW. 1st Ct., Battle Ground, WA (US) 98604

( * ) Notice: Subject to any disclaimer, the term of this patent is extended or adjusted under 35 U.S.C. 154(b) by 177 days.

(21) Appl. No.: 09/878,660

(22) Filed: Jun. 11, 2001

(51) Int. Cl.[7] ..... D05B 15/00; A31D 13/06; A43C 11/12

(52) U.S. Cl. ..... 112/475.16; 2/243.1; 36/50.1

(58) Field of Search ..... 36/1.5, 83, 97, 36/113, 7.1 R, 50.1, 54, 58; 2/243.1, 244, 245; 112/406, 28, 33, 415.08, 475.14, 475.16, 475.09

(56) References Cited

U.S. PATENT DOCUMENTS 2,297,657 A * 9/1942 L'Hollier
2,398,510 A 4/1946 Wilson
3,059,352 A 10/1962 Clason
3,218,737 A 11/1965 Burtoff
3,589,038 A * 6/1971 Sailer
3,875,687 A 4/1975 Henderson
4,512,089 A 4/1985 Carrier
D398,438 S 9/1998 De Baere
5,987,778 A * 11/1999 Stoner
6,128,836 A * 10/2000 Barret
6,185,845 B1 * 2/2001 Gordon

* cited by examiner

*Primary Examiner*—Ismael Izaguirre

(57) ABSTRACT

A method of manufacture for a boot for providing improved accessibility in the wearing of boots for the physically impaired. The method of manufacture includes providing a quantity of leather for making individual portions of a boot; providing a quantity of thread for stitching portions together; providing a plurality of patterns; positioning each one of the plurality of pattern on a surface of the quantity of leather such that each pattern covers a unique area of the quantity of leather; tracing an outline of each one of the plurality of patterns onto the surface of the quantity of leather; cutting along each outline; coupling each individual portion to adjacent portions to form the boot; attaching a closing device to the boot for coupling the boot to a foot of a user; and finishing the boot to improve durability of the boot as well as aesthetic appearance of the boot.

18 Claims, 4 Drawing Sheets

METHOD OF MANUFACTURE FOR A BOOT FOR THE PHYSICALLY IMPAIRED

BACKGROUND OF THE INVENTION

1. Field of the Invention

The present invention relates to manufacturing boots and more particularly pertains to a new method of manufacture for a boot for providing improved accessibility in the wearing of boots for the physically impaired.

2. Description of the Prior Art

The method of manufacturing boots is known in the prior art. More specifically, methods of manufacturing boots heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,512,089; U.S. Pat. No. 3,059,352; U.S. Pat. No. 3,875,687; U.S. Pat. No. 2,398,510; U.S. Pat. No. 3,218,737; and U.S. Pat. No. des. 398,438.

While these devices fulfill their respective, particular objectives and requirements, the aforementioned patents do not disclose a new method of manufacture for a boot for the physically impaired. The inventive device includes providing a quantity of leather for making individual portions of a boot; providing a quantity of thread for stitching portions together; providing a plurality of patterns; positioning each one of the plurality of pattern on a surface of the quantity of leather such that each pattern covers a unique area of the quantity of leather; tracing an outline of each one of the plurality of patterns onto the surface of the quantity of leather; cutting along each outline; coupling each individual portion to adjacent portions to form the boot; attaching a closing device to the boot for coupling the boot to a foot of a user; and finishing the boot to improve durability of the boot as well as aesthetic appearance of the boot.

In these respects, the method of manufacture for a boot for the physically impaired according to the present invention substantially departs from the conventional concepts and designs of the prior art, and in so doing provides an apparatus primarily developed for the purpose of providing improved accessibility in the wearing of boots for the physically impaired.

SUMMARY OF THE INVENTION

In view of the foregoing disadvantages inherent in the known methods of manufacturing boots now present in the prior art, the present invention provides a new method of manufacture for a boot construction wherein the same can be utilized for providing improved accessibility in the wearing of boots for the physically impaired.

The general purpose of the present invention, which will be described subsequently in greater detail, is to provide a new method of manufacture for a boot for the physically impaired apparatus and method which has many of the advantages of the manufacturing boots mentioned heretofore and many novel features that result in a new method of manufacture for a boot for the physically impaired which is not anticipated, rendered obvious, suggested, or even implied by any of the prior art methods of manufacturing boots, either alone or in any combination thereof.

To attain this, the present invention generally comprises providing a quantity of leather for making individual portions of a boot; providing a quantity of thread for stitching portions together; providing a plurality of patterns; positioning each one of the plurality of pattern on a surface of the quantity of leather such that each pattern covers a unique area of the quantity of leather; tracing an outline of each one of the plurality of patterns onto the surface of the quantity of leather; cutting along each outline; coupling each individual portion to adjacent portions to form the boot; attaching a closing device to the boot for coupling the boot to a foot of a user; and finishing the boot to improve durability of the boot as well as aesthetic appearance of the boot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method of manufacture for a boot for the physically impaired which has many of the advantages of the methods of manufacturing boots mentioned heretofore and many novel features that result in a new method of manufacture for a boot for the physically impaired which is not anticipated, rendered obvious, suggested, or even implied by any of the prior art manufacturing boots, either alone or in any combination thereof.

It is another object of the present invention to provide a new method of manufacture for a boot for the physically impaired which may be easily and efficiently manufactured and marketed.

It is a further object of the present invention to provide a new method of manufacture for a boot for the physically impaired which is of a durable and reliable construction.

An even further object of the present invention is to provide a new method of manufacture for a boot for the physically impaired which is susceptible of a low cost of manufacture with regard to both materials and labor, and which accordingly is then susceptible of low prices of sale to the consuming public, thereby making such method of manufacture for a boot for the physically impaired economically available to the buying public.

Still yet another object of the present invention is to provide a new method of manufacture for a boot for the physically impaired which provides in the apparatuses and methods of the prior art some of the advantages thereof, while simultaneously overcoming some of the disadvantages normally associated therewith.

Still another object of the present invention is to provide a new method of manufacture for a boot for the physically impaired for providing improved accessibility in the wearing of boots for the physically impaired.

Yet another object of the present invention is to provide a new method of manufacture for a boot for the physically impaired which includes providing a quantity of leather for making individual portions of a boot; providing a quantity of thread for stitching portions together; providing a plurality of patterns; positioning each one of the plurality of pattern on a surface of the quantity of leather such that each pattern covers a unique area of the quantity of leather; tracing an outline of each one of the plurality of patterns onto the surface of the quantity of leather; cutting along each outline; coupling each individual portion to adjacent portions to form the boot; attaching a closing device to the boot for coupling the boot to a foot of a user; and finishing the boot to improve durability of the boot as well as aesthetic appearance of the boot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
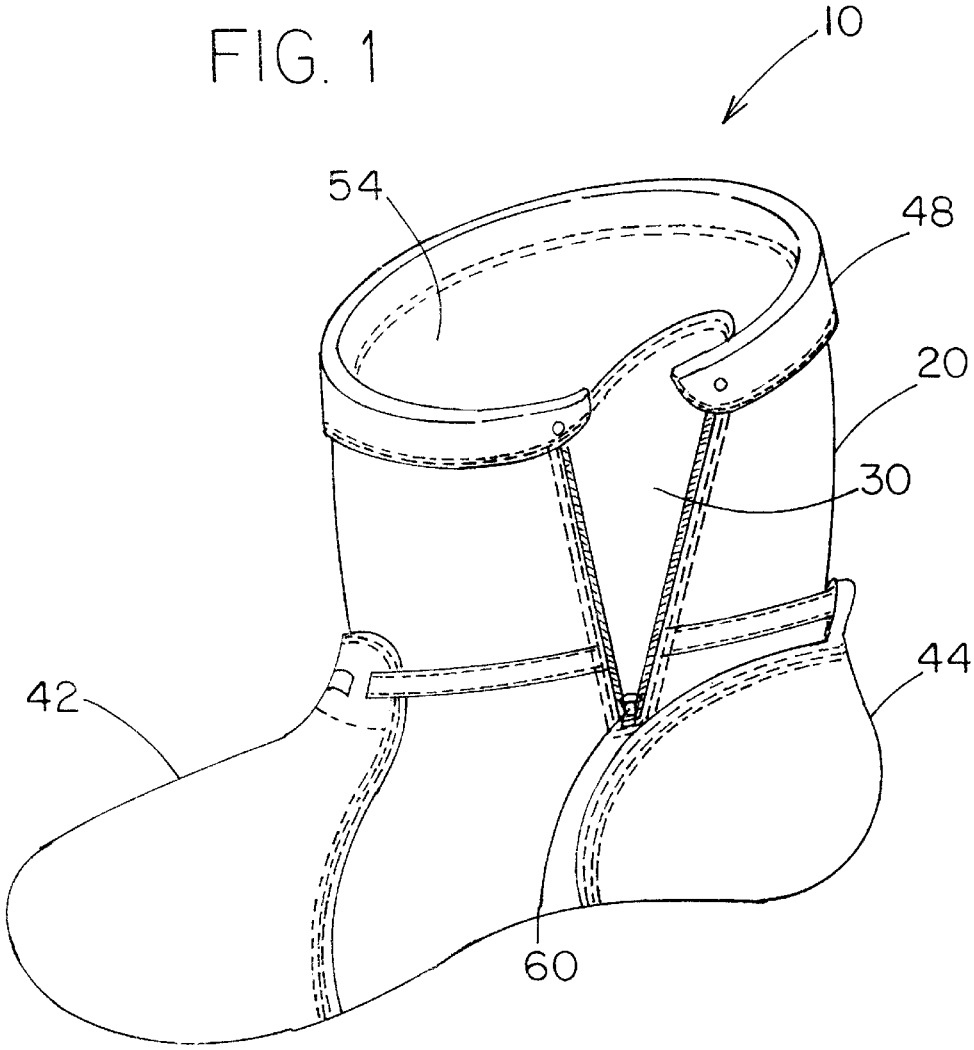
FIG. 1 is a schematic perspective view of a new boot for the physically impaired according to the present invention.
Figure 2:
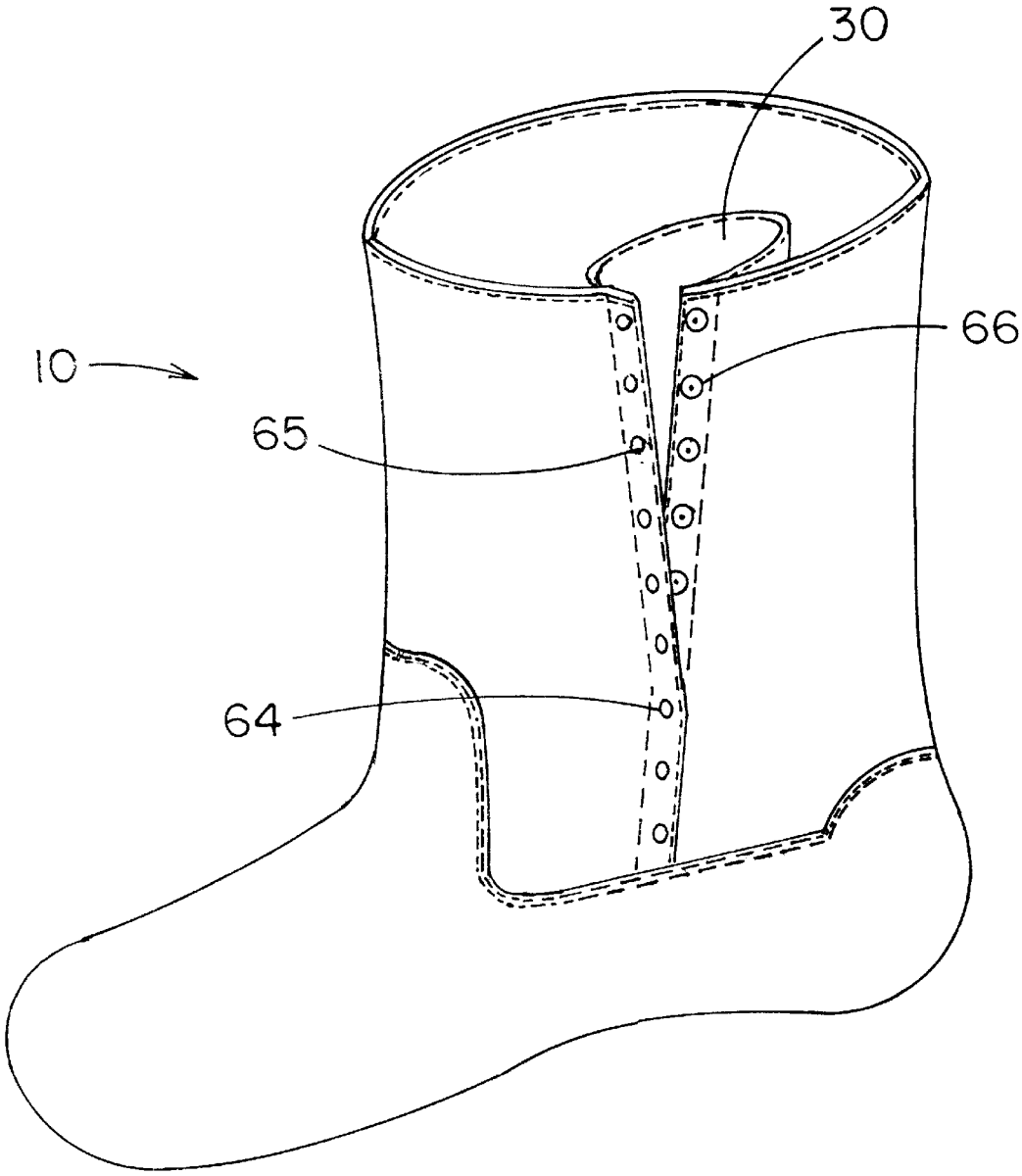
FIG. 2 is a schematic perspective view of and embodiment of the present invention.
Figure 3:
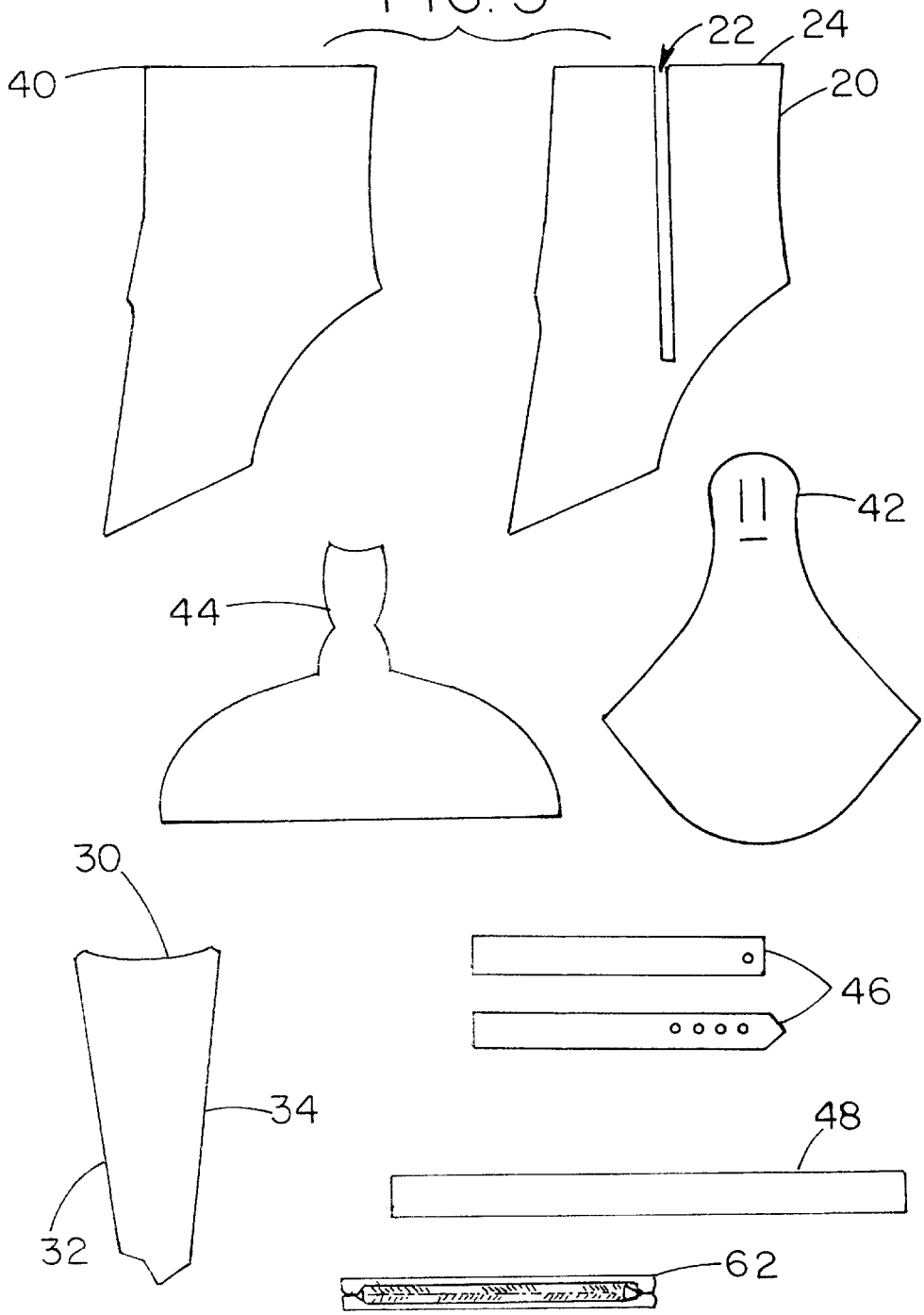
FIG. 3 is a schematic front view of the individual portions of the present invention.
Figure 4:
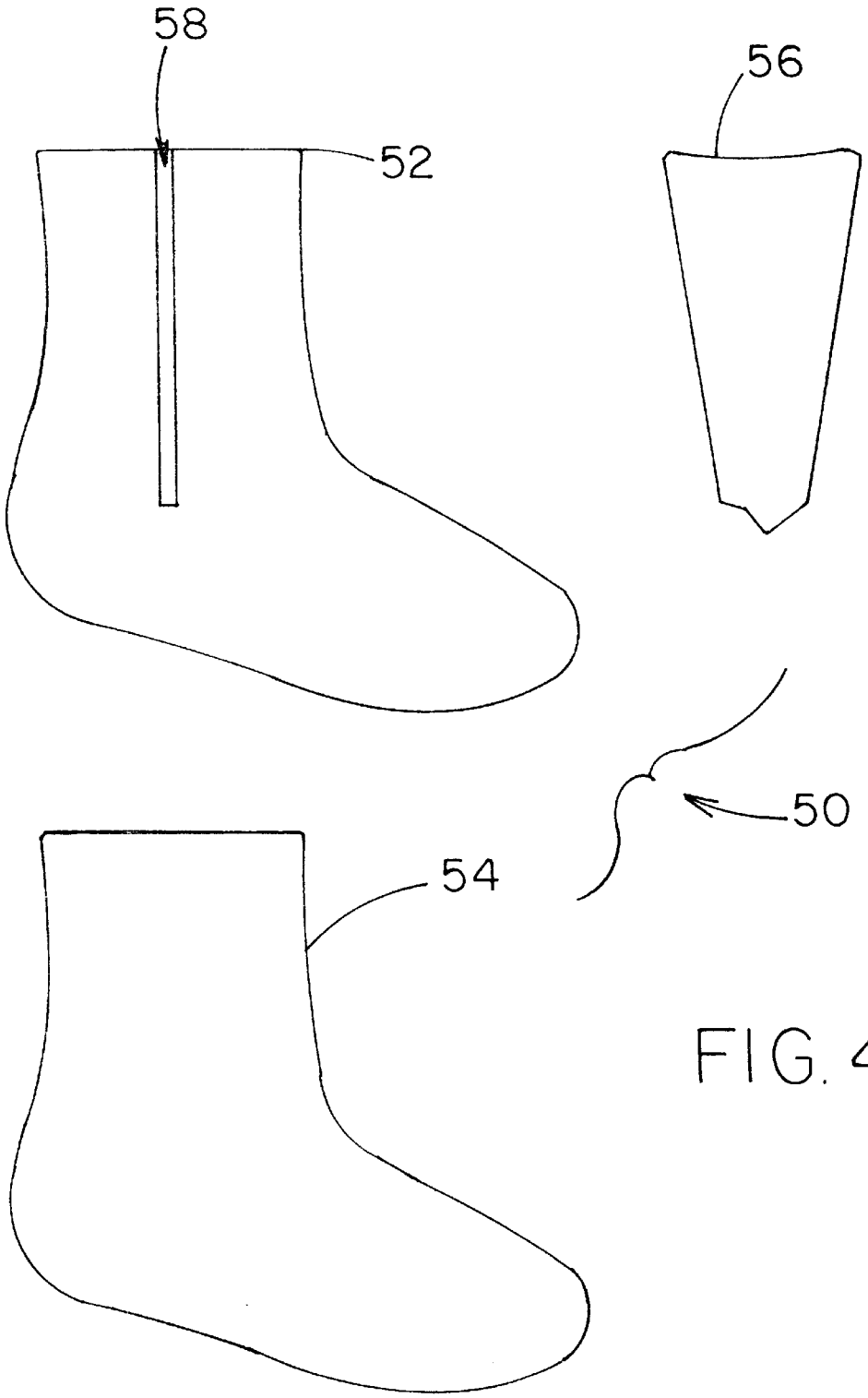
FIG. 4 is a schematic front view of the portions of the lining of the present invention.

With reference now to the drawings, and in particular to FIGS. 1 through 4 thereof, a new method of manufacture for a boot for the physically impaired embodying the principles and concepts of the present invention and generally designated by the reference numeral 10 will be described.

As best illustrated in FIGS. 1 through 4, the method of manufacture for a boot for the physically impaired 10 generally comprises providing the material to construct the boot and lining, providing a plurality of patterns for the individual portions of the boot and lining, tracing the patterns onto the material, cutting the material, and coupling the individual portions together.

A quantity of leather for making individual portions of the boot 10 such as an outer quarter 40, inner quarter 20, vamp 42, counter pocket with pull tab 44, triadd 30, adjustable strap 46, and a binding strap (collar) 48 is provided. Additionally a plurality of patterns each corresponding to an associated one of said individual portions of the boot 10 is provided. Each one of said plurality of patterns is positioned on a surface of the quantity of leather such that each pattern covers a unique area of the quantity of leather. Also a quantity of thread 70 to stitching individual portion is provided.

An outline of each one of said plurality of patterns is traced onto the surface of the quantity of leather such that an outline of each one of the plurality of patterns is visible on the surface of the quantity of leather.

The quantity of leather is cut along each outline such that each individual portion is separated from said quantity of leather. Each individual portion is then coupled to the adjacent portions to form a boot. A closing device 60 is then coupled to the boot 10 to facilitate securing the boot 10 to a foot of a user.

The boot 10 is then finished to improve durability of the boot 10 as well as aesthetic appearance.

In an embodiment the quantity of leather provided comprises full grain leather in a range of 6 to 7 ounces.

The inner quarter 20 further comprises a slit 22, which positioned such that a longitudinal axis of the slit 22 is collinear with a longitudinal axis of the inner quarter 20. The slit 22 is positioned such that the slit 22 extends from a medial portion of a top edge 24 of the inner quarter 20 downward towards a lower edge of the inner quarter 20. The slit 24 is used for receiving the closing device 60.

A quantity of adhesive may be provided for coupling the closure device 60 to the inner surface of the inner quarter 20. The quantity of adhesive is applied on an inner surface of the inner quarter 20 substantially adjacent to each side of the slit 24. The inner surface is opposite of the surface receiving the tracing of the patterns.

A closure device 60 is positioned face down on the inner surface substantially over the slit 24. The quantity of adhesive is allowed to cure such that the closure device 60 is held in a substantially static position relative to said slit 24.

A backstitch is performed through the inner quarter 20 and the closure device 60 adjacent to an upper end 24 of the inner quarter 20 and adjacent to the slit 24. The seam is continued by stitching along a perimeter of the slit 24 such that the closure device 60 is stitched to the inner quarter 20. Next a second backstitch is performed through the inner quarter 20 and the closure device 60 adjacent to the upper end of the inner quarter 20 and adjacent to the slit 24 but opposite of the prior backstitch such that the stitching of the closure device 60 to the inner quarter 20 begins and ends with a backstitch.

The triadd 30 is positioned adjacent to an edge of the slit 24 such that an unfinished edge of the triadd 30 abuts the edge of the slit 24. A quantity of adhesive is provided. The quantity of adhesive is applied to the edge 32 and second edge 34 of the triadd 30 and to the inner quarter 20 prior to stitching. Both the edge 32 and second edge 34 of the triadd 30 are positioned to abut an associated one of the edge and second edge of the slit 24. The adhesive is cured prior to stitching.

The edge 32 of triadd 30 is stitched to the inner quarter 20 adjacent to the edge of the slit 24. The triadd 30 is then folded back upon itself such that the finished surface is visible through the slit 24. A second edge 34 of the triadd 30 is also folded back upon itself such that the unfinished surface of the triadd 30 abuts a second edge of the slit 24. The second edge 34 of the triadd 30 is stitched to the inner quarter 20 adjacent to the second edge of the slit 24. A backstitch is performed through the inner quarter 20 and the triadd 30. The backstitch is positioned adjacent to the stitching adjacent to the edge of the slit 24. A second row of stitches is performed coupling the triadd 30 to the inner quarter 20 such that the stitches are positioned in a spaced relationship with a first row of stitching. Similar to the first row a backstitch is performed through the inner quarter 20 and the triadd 30 adjacent to the upper end 24 of the inner quarter 20 and adjacent to the slit 24 but opposite of the prior backstitch such that the stitching of the triadd 30 to the inner quarter 20 begins and ends with a backstitch.

A quantity of material is provided for making individual portions of a lining 50. Additionally, a plurality of patterns is also provided. Each of the plurality of patterns corresponding to an associated individual portion of the lining 50 such as an inner quarter lining 52, outer quarter lining 54, and triadd lining 56. Each one of the plurality of patterns is positioned on a surface of the quantity of material such that each pattern covers a unique area of the quantity of material. An outline of each one of the plurality of patterns is traced onto the surface of the quantity of material such that an outline of each one of the plurality of patterns is visible on the surface of the quantity of material. The material is cut along each outline such that each individual portion of the lining 50 is separated from the quantity of material. Next each individual portion is coupled to adjacent portions to form a lining 50 for a boot 10.

In an embodiment the material provided for the lining 50 is selected from the group consisting of cotton drill, combrella, leather, and polyolefin/polyester blend.

The triadd lining 56 is positioned adjacent to an edge of a slit 58 in the inner quarter lining 52 such that an finished edge of the triadd lining 56 abuts the edge of the slit 8. The edge of triadd lining 56 is stitched to the inner quarter lining 52 adjacent to the edge of the slit 58. The triadd lining 56 is folded back upon itself such that the unfinished surface is visible through the slit 58. A second edge of the triadd lining 56 is also folded such that the finished surface of the triadd lining 56 abuts a second edge of the slit 58.

The second edge of the triadd lining 56 is stitched to the inner quarter lining 52 adjacent to the second edge of the slit 58. A backstitch is performed through the inner quarter lining 52 and the triadd lining 56. The backstitch is positioned adjacent to the stitching adjacent to the edge of the slit 58. The triadd lining is also stitched to the inner quarter lining 52 by a second row of stitches such that the stitches are positioned in a spaced relationship with a first row of stitching. Similarly a backstitch is performed through the inner quarter lining 52 and the triadd lining 56 adjacent to the upper end of the inner quarter lining 52 and adjacent to the slit 58 but opposite of the prior backstitch such that the stitching of the triadd lining 56 to the inner quarter lining 52 begins and ends with a backstitch.

In an embodiment, the closure device 60 comprises a zipper 62.

In a further embodiment the closure device 60 comprises a plurality of snaps 64 having a first set 65 and a second set 66. Each one of the first set 65 of the plurality of snaps 64 is coupled to a first piece of material for facilitating attaching the snaps 64 to the inner quarter 20. Each one of the second set 66 of the plurality of snaps 64 is coupled to a second piece of material for facilitating attaching the plurality of snaps 64 to the inner quarter 20.

The process steps in the construction of the resulting boot incorporating a zipper closure for facilitating access by mobility challenged individuals are summarized in the next several paragraphs. Each paragraph describes an individual process step, however multiple operations integral to the process step may be described.

Operation #1. All the patterns should be laid on leather and cut respecting conventional the cutting rules.

Operation #2. It is important that all the patterns are marked properly in order to assure that the overlapping is done evenly. Marking should be done on right side of leather.

Operation #3. The edges that need to be joined by an overlapping seam, need to be skived. Also, edges of the inner and outer quarters need to be skived.

Operation #4. The edges that are overlapping and the edges which are to be seen need to be finished up and colored.

Operation #5. The upper edge binding strap (collar), the adjustable strap, and the triadd need to be split.

Operation #6. An industrial zipper should be used. These types of zippers are heavy duty. The slider of the zipper is especially designed with a pin that secures the zipper in place. The purpose is to prevent from sliding down during wearing. The color and size of zipper should match the color of the leather and the height of boot. This experimental Slip & Zip boot is brown and needs a zipper size 7". As it can be seen, the inner quarters have the slot already cut to fit the zipper, and have enough room for the slider to move freely. The zipper should be placed facedown on the wrong side of the leather, within the markings made for it. It should be glued down first, so that the center of the teeth would be placed in the center of the slot. It has to be made sure that the glue is spread carefully so that it won't get on the zippers teeth. Also the distance between the teeth and the quarter edges is kept evenly. After it gets dried it may be transferred to the next operation, stitching down.

Operation #7. Stitching Down is performed in a series of steps as follows:

Step #1 It starts by stitching down the zipper, first row, with a top stitch (⅛") close to the edge, all around the edges. A backstitch should be used at the beginning and the end of the seam to strengthen the seam.

Step #2 Attaching the triadd to the quarter, at the straight edge, wrong sides together, the edge of the quarter over the edge of the triadd. Attaching should be done by stitching a second row parallel with the first row. This seam is both decorative and functional.

Step #3 This step may be done by gluing first or direct by stitching. After the quarter and triadd had been sewn together at one side the process continues by folding the triadd on designated points. Some glue may be applied first on the right side of the triadd on a width of ½ inch, at the edge and, also the same width on the wrong side of the zipper tape. Then and edge of the quarter should be stitched wrong side down, by overlapping the edge of the triadd, which is positioned right side up. The overlapping should not exceed 1 inch in width. The seam used is a functional and a decorative seam in the same time. It should be started with backstitch on a predetermined point as a second row.

Step #4 After the zipper is closed, the process continues with stitching the quarters (inner and outer) right sides together, and joining them at the straight edge. The stitching should be started by sewing the front seam, and starting and ending with a backstitch. Now this seam may be left as it is after it has been softened, or it may be reinforced. To reinforce the seem, a hot tape may be applied on the wrong side of the seam and then followed by top stitching operation on a doubled needle machine, or single needle machine, keeping the line of the seam in the center. This type of seam is stronger and it looks more beautiful with a top stitch.

Step #5 The quarters that have been sewed together at the front seam, should be opened flat. Now the vamp should be stitched down by overlapping with a top straight edge stitch on a double needle machine. The overlapping width should be a minimum of ⅝ inch, so that there would be enough allowances for a third row of stitches.

Step #6 The third row must be stitched at the same and even distances the first and second row. It is known that the two slits on the vamp are for the purpose of treading the adjustable strap through. For complete accuracy it is necessary that the quarters would be designed with an additional overlapping and seam allowances.

Step #7 Closing the quarters together may be done by joining them at a straight edge, right sides together. This seam needs to be softened (smoothed). Now the seam may be left as it is or it may be reinforced like the front seam. After this step is done, the boot should be turned face out.

If the quarters are cut out of thick and stiff leather, then the turning may be difficult. In this case step 7 should be done before step 6.

Step #8 Applying the counter pocket. The counter pocket used in these patterns has the pull-tab attached to it, whose ends should be folded inwardly in a form of a loop. It is used mainly for threading the adjustable strap through the formed loop and also as a pulling tab.

Operation #8. Making the adjustable strap and attaching the buckle. A width of the strap should be the same as the width of the bar (inside the buckle). The strap maybe cut out of full grain leather, of the designed width approximately ¾ inch and it may be left as a single layer. In this case the strap needs to have the edges finished, and a formal seam may be stitched all around as a straight edge stitch. This type of straps are recommended to be used on work boots, but for uniform casual or dress boots it is recommended that the strap would be made using some other methods like, double layer, triple, or four layers. For women's boots, two narrow adjustable straps would provide a more stylish appearance. To attach a buckle to a strap, simply a slot should be punched about 1½ inches from the end of the strap. The leather strap needs to be threaded under the back of the buckle, up and over the bar. The prong of the buckle should be inserted through the slot, and back under the leather strap so there is a loop created around the bar, but under the buckle. The loop should be made tight, and the two layers should be riveted together about ½ inch back from the end of the bar.

Operation #9. Threading the adjustable strap. Before securing the adjustable strap in its place, it should be threaded through the loop of the pull-tab and the slots of the vamp and buckled up at the desired length.

Operation #10. Attaching the adjustable strap to the boot. There is an alignment between the loop formed by the inverted pull-tab and the slot of the vamp. Under these circumstances it is very easy to position the strap in its place. Both ends of the two pieces of the adjustable strap need to be placed by being stitched on both sides of the zipper in spaced apart relation. The ends should be aligned at the straight edge, wrong side down on the quarters. The seam needs to be done on a single needle machine starting as a continuing line on the first row at the zipper. Coming back parallel on the second row and finishing by stitching once more on the same holes of the first row. The stitches of this particular seam should match the stitches on both sides of the zipper.

Operation #11. Making the lining. After choosing the type and the design of the lining, the patterns may be cut out. Joining them together needs to be done by using a double over lock machine.

There are a variety of linings that can be used. For work boots, for example, 400 gr. thinsulate insulation may be used. If it is necessary, an extra lining may be used for double lining. These linings may be cut after like patterns or other patterns may be used, such as an ankle double lining. When using double lining, the triadd does not need to have double lining, and as a matter of fact, it does not need to be cut out of thick lining either. For waterproof boots, it is recommended that hot tape would be applied on all the seams. For any other type of boots such as dress boots and uniform boots some other types of lining may be used like: cotton drill, combrella lining, leather and some other breathable materials.

Operation #12. Attaching the lining to the boot. The inner side of the finished lining is the right side, contrary to the boot which has the exterior as a right side. To attach the lining it starts by inserting it into the boot, wrong sides together, at the even upper raw edge. It needs to be sewn all around by using a single needle sewing machine. The type of seam used is a straight edge stitch, on the right side of the boot (leather facing up). First the triadd area needs to be stitched starting and ending with a backstitch.

Operation #13. Applying the upper edge binding strap (also called a collar). Applying the binding strap needs to be done on a single needle sewing machine by using a straight edge stitch. The binding strap needs to be applied right side down on the lining side of the boot. The binding strap needs to be aligned to the upper edge and also ¼ inch longer then the teeth of the zipper. The stitching starts on point A with a backstitch, and trying to stay as close as possible to the long edge of the binding strap. In the meantime it is necessary that the stitching pierces through all three layers, about on top of the seam used for stitching the lining.

Operation #14. Softening (smoothing). After the binding strap has been applied, the upper edges of the boot need to go through a softening process. The softening, like the trimming are required to be done properly in order for the next operations to go successfully.

Operation #15. Flipping the binding strap and stitching it down. This operation finishes up the upper edge of the boot. It can be done on either single or double needle dewing machine. To make the stitching part easier, it may be started by gluing down first so the sewer would not have to struggle with the flipping, holding in place and stitching the binding strap at the same time. A thin layer of glue needs to be applied on the wrong side of the binding strap and also on the upper edge of the boot on a surface of ¾ inch of the total width of the strap. After the glue drys the strap needs to be flipped over the top edge of the boot. It is important that the seam would be pressed and pushed very well upwardly before flipping so that the binding strap would stick to the very upper edge first, and then would fall on the outside of the boot. If all prior operations were done properly, then the collar would look even on the outside. Stitching the collar with a single or double row stitch through all the thicknesses requires the same technique. The corners need to be trimmed a little bit rounded and also if there are any thread ends they need to be cut close to the seams. The first thing that needs to be trimmed is the edge of the triadd on the back of the zipper in order for the slider to run smoothly.

Operation #16. The last operation is applying a hot tape on the wrong side of the seams. The hot tape it is required if making waterproof boots. The hot tape may be done by machines. 39.

The ends of the collar may be left as they are or a snap may be added. If this option is chosen, then there are some changes that need to be done:

1) The binding strap has to be cut ¾ inch longer on both ends, and also marked on these points.
2) When stitching the binding strap, it has to be made sure that the marked length ¾ inch is left longer than the teeth of the zipper on both ends.
3) Before flipping over the binding strap, there is a piece of leather, similar to the binding strap, that needs to be attached. This rectangular piece of leather has to be stitched wrong side down on the right side of the binding strap. This is part of the finishing operations and it has the purpose to cover the back of the binding strap ends, and also to strengthen the ends and enable them to hold the snaps.
4) Applying a snap. Snaps are one of the most useful of closures for leather makings. It is very easy and fast to apply one. The snaps come in various sizes and colors for all types of leathers and thicknesses. The color and size should be chosen according to the color of the boot and also the thickness of the leather and most specifically to the thickness of the collar. Applying snaps needs to be done by machine. One thing that has to be done before sending the boot to the snapping machine, is to mark where the snap is to be on both sides of the collar ends. The snap should be centered exactly in the middle of the collar ends and also should be aligned to the center of the teeth of the closed zipper.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boot making method for improving accessibility to those who are physically impaired, the steps of the method comprising:

providing a quantity of leather for making individual portions of a boot including an outer quarter, inner quarter, vamp, counter pocket with pull tab, triadd, adjustable strap, and a binding strap (collar);

providing a quantity of thread for stitching portions together;

providing a plurality of patterns, each one of said plurality of patterns corresponding to an associated one of said individual portions of said boot;

positioning each one of said plurality of pattern on a surface of said quantity of leather such that each pattern covers a unique area of said quantity of leather;

tracing an outline of each one of said plurality of patterns onto said surface of said quantity of leather such that an outline of each one of said plurality of patterns is visible on said surface of said quantity of leather;

cutting along each outline such that each individual portion of said boot is separated from said quantity of leather;

coupling each individual portion to adjacent portions to form said boot;

attaching a closing device to said boot for coupling said boot to a foot of a user by allowing the mouth of the boot to be relatively wider while the user is putting on said boot and then being somewhat constricted by said closing device;

finishing said boot to improve durability of said boot as well as aesthetic appearance of said boot; and wherein said inner quarter further comprises a slit, said slit being positioned such that a longitudinal axis of said slit is collinear with a longitudinal axis of said inner quarter, said slit being positioned such that said slit extends from a medial portion of a top edge of said inner quarter downwardly towards a lower edge of said inner quarter, said slit being for receiving said closing device.

2. The method of making a boot of claim 1, wherein said quantity of leather provided comprises full grain leather having a weight more than about 6 ounces and less than about 7 ounces.

3. The method of making a boot of claim 1, wherein said closing device comprises a zipper.

4. A boot making method for improving accessibility to those who are physically impaired, the steps of the method comprising:

providing a quantity of leather for making individual portions of a boot including an outer quarter, inner quarter, vamp, counter pocket with pull tab, triadd, adjustable strap, and a binding strap (collar);

providing a quantity of thread for stitching portions together;

providing a plurality of patterns, each one of said plurality of patterns corresponding to an associated one of said individual portions of said boot;

positioning each one of said plurality of pattern on a surface of said quantity of leather such that each pattern covers a unique area of said quantity of leather;

tracing an outline of each one of said plurality of patterns onto said surface of said quantity of leather such that an outline of each one of said plurality of patterns is visible on said surface of said quantity of leather;

cutting along each outline such that each individual portion of said boot is separated from said quantity of leather;

coupling each individual portion to adjacent portions to form said boot;

attaching a closing device to said boot for coupling said boot to a foot of a user by allowing the mouth of the boot to be relatively wider while the user is putting on said boot and then being somewhat constricted by said closing device;

finishing said boot to improve durability of said boot as well as aesthetic appearance of said boot;

said quantity of leather provided comprises full grain leather having a weight more than about 6 ounces and less than about 7 ounces;

said closing device comprises a zipper;

said inner quarter further comprises a slit, said slit being positioned such that a longitudinal axis of said slit is collinear with a longitudinal axis of said inner quarter, said slit being positioned such that said slit extends from a medial portion of a top edge of said inner quarter downwardly towards a lower edge of said inner quarter, said slit being for receiving said closing device.

5. The method of claim 4, further comprising:

providing a quantity of adhesive for coupling said zipper to said inner surface of said inner quarter;

applying said quantity of adhesive on a inner surface of said inner quarter substantially adjacent to each side of said slit, said inner surface being opposite of said surface receiving the tracing of said pattern;

positioning said zipper face down on said inner surface substantially over said slit, curing said quantity of adhesive to cure such that said zipper is held in a substantially static position relative to said slit.

6. The method of claim 5, further comprising:

performing, a backstitch through said inner quarter and said zipper adjacent to an upper end of said inner quarter and adjacent to said slit;

stitching along a perimeter of said slit such that said zipper is stitched to said inner quarter;

performing a backstitch through said inner quarter and said zipper adjacent to said upper end of said inner quarter and adjacent to said slit but opposite of the backstitch adjacent to said upper end such that the stitching of said zipper to said inner quarter begins and ends with a backstitch.

7. The method of claim 6, further comprising:

attaching said triadd to said inner quarter such that a buffer between an opening is created by said slit and in interior of said boot, said triadd being positioned such that a finished surface of said triadd is visible through said slit.

8. The method of claim 7, further comprising:

positioning said triadd adjacent to an edge of said slit such that an unfinished edge of said triadd abuts said edge of said slit;

stitching said unfinished edge of said triadd to said inner quarter adjacent to said edge of said slit;

folding said triadd back upon itself such that said finished surface is visible through said slit;

folding a second edge of said triadd such that said unfinished surface of said triadd abuts a second edge of said slit;

stitching said second edge of said triadd to said inner quarter adjacent to said second edge of said slit.

9. The method of claim 8, further comprising:

providing a quantity of adhesive;

applying said quantity of adhesive to said edge and second edge of said triadd to said inner quarter prior to stitching, each of said edge and second edge of said triadd being positioned to abut an associated one of said edge and second edge of said slit;

curing said adhesive prior to stitching.

10. The method of claim 8, further comprising:

performing a backstitch through said inner quarter and said triadd, said backstitch being positioned adjacent to said stitching adjacent to said edge of said slit;

stitching said triadd to said inner quarter such that said stitches are positioned in a spaced relationship with a first row of stitching;

performing a backstitch through said inner quarter and said triadd adjacent to said upper end of said inner quarter and adjacent to said slit but opposite of the backstitch adjacent to said upper edge such that the stitching of said triadd to said inner quarter begins and ends with a backstitch.

11. The method of claim 4, further comprising:

providing a quantity of material for making individual portions of a lining;

providing a plurality of patterns, each of said plurality of patterns corresponding to an associated individual portion of said lining including an inner quarter lining, outer quarter lining, and triadd lining;

positioning each one of said plurality of patterns on a surface of said quantity of material such that each pattern covers a unique area of said quantity of material;

tracing an outline of each one of said plurality of patterns onto said surface of said quantity of material such that an outline of each one of said plurality of patterns is visible on said surface of said quantity of material;

cutting along each outline such that each individual portion of said lining is separated from said quantity of material; and coupling each individual portion to adjacent portions to form said lining for said boot.

12. The method of claim 11, further comprising:

wherein said material provided is selected from the group consisting of cotton drill, combrella, leather, and polyolefin/polyester blend.

13. The method of claim 11, further comprising:

positioning said triadd lining adjacent to an edge of a slit in said inner quarter lining such that an finished edge of said triadd lining abuts said edge of said slit;

stitching said unfinished edge of triadd lining to said inner quarter lining adjacent to said edge of said slit;

folding said triadd lining back upon itself such that said unfinished surface is visible through said slit;

folding a second edge of said triadd lining such that said finished surface of said triadd lining abuts a second edge of said slit;

stitching said second edge of said triadd lining to said inner quarter lining adjacent to said second edge of said slit;

performing a backstitch through said inner quarter lining and said triadd lining, said backstitch being positioned adjacent to said stitching adjacent to said edge of said slit;

stitching said triadd lining to said inner quarter lining such that said stitches are positioned in a spaced relationship with a first row of stitching;

performing a backstitch through said inner quarter lining and said triadd lining adjacent to said upper end of said inner quarter lining and adjacent to said slit but opposite of the backstitch adjacent to said upper edge such that the stitching of said triadd lining to said inner quarter lining begins and ends with a backstitch.

14. A boot making method for improving accessibility to those who are physically impaired, the steps of the method comprising:

providing a quantity of leather for making individual portions of a boot including an outer quarter, inner quarter, vamp, counter pocket with pull tab, triadd, adjustable strap, and a binding strap (collar);

providing a quantity of thread for stitching portions together;

providing a plurality of patterns, each one of said plurality of patterns corresponding to an associated one of said individual portions of said boot;

positioning each one of said plurality of pattern on a surface of said quantity of leather such that each pattern covers a unique area of said quantity of leather;

tracing an outline of each one of said plurality of patterns onto said surface of said quantity of leather such that an outline of each one of said plurality of patterns is visible on said surface of said quantity of leather;

cutting along each outline such that each individual portion of said boot is separated from said quantity of leather;

coupling each individual portion to adjacent portions to form said boot;

attaching a closing device to said boot for coupling said boot to a foot of a user by allowing the mouth of the boot to be relatively wider while the user is putting on said boot and then being somewhat constricted by said closing device;

finishing said boot to improve durability of said boot as well as aesthetic appearance of said boot;

said quantity of leather provided comprises full grain leather having a weight more than about 6 ounces and less than about 7 ounces;

said inner quarter further comprises a slit, said slit being positioned such that a longitudinal axis of said slit is collinear with a longitudinal axis of said inner quarter, said slit being positioned such that said slit extends from a medial portion of a top edge of said inner quarter downwardly towards a lower edge of said inner quarter, said slit being for receiving said closing device;

providing a quantity of adhesive for coupling said closure device to said inner surface of said inner quarter;

applying said quantity of adhesive on a inner surface of said inner quarter substantially adjacent to each side of said slit, said inner surface being opposite of said surface receiving the tracing of said pattern;

positioning said closure device face down on said inner surface substantially over said slit, curing said quantity of adhesive to cure such that said closure device is held in a substantially static position relative to said slit;

performing a backstitch through said inner quarter and said closure device adjacent to an upper end of said inner quarter and adjacent to said slit;

stitching along a perimeter of said slit such that said closure device is stitched to said inner quarter;

performing a backstitch through said inner quarter and said closure device adjacent to said upper end of said inner quarter and adjacent to said slit but opposite of the backstitch adjacent to said upper edge such that the stitching of said closure device to said inner quarter begins and ends with a backstitch;

positioning said triadd adjacent to an edge of said slit such that an unfinished edge of said triadd abuts said edge of said slit;

providing a quantity of adhesive;

applying said quantity of adhesive to said edge and second edge of said triadd to said inner quarter prior to stitching, each of said edge and second edge of said triadd being positioned to abut an associated one of said edge and second edge of said slit;

curing said adhesive prior to stitching stitching said edge of triadd to said inner quarter adjacent to said edge of said slit;

folding said triadd back upon itself such that said finished surface is visible through said slit;

folding a second edge of said triadd such that said unfinished surface of said triadd abuts a second edge of said slit;

stitching said second edge of said triadd to said inner quarter adjacent to said second edge of said slit;

performing a backstitch through said inner quarter and said triadd, said backstitch being positioned adjacent to said stitching adjacent to said edge of said slit;

stitching said triadd to said inner quarter such that said stitches are positioned in a spaced relationship with a first row of stitching;

performing a backstitch through said inner quarter and said triadd adjacent to said upper end of said inner quarter and adjacent to said slit but opposite of the backstitch adjacent to said upper edge such that the stitching of said triadd to said inner quarter begins and ends with a backstitch;

providing a quantity of material for making individual portions of a lining;

providing a plurality of patterns, each of said plurality of patterns corresponding to an associated individual portion of said lining such as an inner quarter lining, outer quarter lining, and triadd lining;

positioning each one of said plurality of patterns on a surface of said quantity of material such that each pattern covers a unique area of said quantity of material;

tracing an outline of each one of said plurality of patterns onto said surface of said quantity of material such that an outline of each one of said plurality of patterns is visible on said surface of said quantity of material;

cutting along each outline such that each individual portion of said lining is separated from said quantity of material;

coupling each individual portion to adjacent portions to form said lining for said boot;

wherein said material provided is selected from the group consisting of cotton drill, combrella, leather, and polyolefin/polyester blend;

positioning said triadd lining adjacent to an edge of a slit in said inner quarter lining such that an finished edge of said triadd lining abuts said edge of said slit;

stitching said edge of triadd lining to said inner quarter lining adjacent to said edge of said slit;

folding said triadd lining back upon itself such that said unfinished surface is visible through said slit;

folding a second edge of said triadd lining such that said finished surface of said triadd lining abuts a second edge of said slit;

stitching said second edge of said triadd lining to said inner quarter lining adjacent to said second edge of said slit;

performing a backstitch through said inner quarter lining and said triadd lining, said backstitch being positioned adjacent to said stitching adjacent to said edge of said slit;

stitching said triadd lining to said inner quarter lining such that said stitches are positioned in a spaced relationship with a first row of stitching;

performing a backstitch through said inner quarter lining and said triadd lining adjacent to said upper end of said inner quarter lining and adjacent to said slit but opposite of the prior backstitch such that the stitching of said triadd lining to said inner quarter lining begins and ends with a backstitch.

15. The method of claim 14, wherein said closure device comprises a zipper.

16. The product produced by the method of claim 15.

17. The method of claim 14, wherein said closure device comprises a plurality of snaps having a first set and a second set, each one of said first set of said plurality of snaps being coupled to a first piece of material for facilitating attaching said snaps to said inner quarter, each one of said second set of said plurality of snaps being coupled to a second piece of material for facilitating attaching said plurality of snaps to said inner quarter.

18. The product produced by the method of claim 17.

* * * * *